US007216628B2

(12) United States Patent
Hayakawa

(10) Patent No.: US 7,216,628 B2
(45) Date of Patent: May 15, 2007

(54) FUEL INJECTION APPARATUS HAVING COMMON RAIL AND SUBJECT DEVICE CONTROL SYSTEM

(75) Inventor: Yoshiki Hayakawa, Kuwana (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 22 days.

(21) Appl. No.: 11/268,628

(22) Filed: Nov. 8, 2005

(65) Prior Publication Data

US 2006/0096579 A1 May 11, 2006

(30) Foreign Application Priority Data

Nov. 8, 2004 (JP) ..... 2004-324018

(51) Int. Cl.
*F02M 37/04* (2006.01)

(52) U.S. Cl. ..... 123/458; 123/446

(58) Field of Classification Search ..... 123/458, 123/456, 446, 447, 506, 467
See application file for complete search history.

(56) References Cited

U.S. PATENT DOCUMENTS 4,777,921 A 10/1988 Miyaki et al.
6,135,090 A * 10/2000 Kawachi et al. ..... 123/446
6,230,684 B1 * 5/2001 Furuhashi et al. ..... 123/467
6,776,141 B2 * 8/2004 Hamada et al. ..... 123/458

FOREIGN PATENT DOCUMENTS

JP 2000-282929 10/2000

* cited by examiner

*Primary Examiner*—Thomas Moulis
(74) *Attorney, Agent, or Firm*—Nixon & Vanderhye P.C.

(57) ABSTRACT

An ECU controls an intake metering valve and sets an upper limit of an integral term, which is obtained based on a pressure difference between a target rail pressure and an actual rail pressure of a common rail. Furthermore, the ECU reduces the target rail pressure when the integral term is limited.

9 Claims, 5 Drawing Sheets

FUEL INJECTION APPARATUS HAVING COMMON RAIL AND SUBJECT DEVICE CONTROL SYSTEM

CROSS REFERENCE TO RELATED APPLICATION

This application is based on and incorporates herein by reference Japanese Patent Application No. 2004-324018 filed on Nov. 8, 2004.

BACKGROUND OF THE INVENTION

1. Field of the Invention

The present invention relates to a fuel injection apparatus, which has a common rail and performs a feedback control operation for approximating an actual rail pressure of the common rail to a target rail pressure, and further relates to a subject device control system, which performs a feedback control operation for approximating an output result of a subject device to a target output.

2. Description of Related Art

The background art of the invention will be described with reference to a fuel injection apparatus having a common rail (or simply referred to as a common rail type fuel injection apparatus).

In the common rail type fuel injection apparatus, high pressure fuel is supplied to the common rail from a high pressure pump, which is installed in a supply pump arrangement, and the high pressure fuel, which is accumulated in the common rail, is injected into cylinders of an internal combustion engine through injectors.

A rail pressure in the common rail corresponds to an injection fuel pressure of the injectors and is adjusted by an intake metering valve, which is installed in the supply pump arrangement. When a degree of opening of the intake metering valve is adjusted, the rail pressure of the common rail is controlled and is adjusted.

The degree of opening of the intake metering valve is corrected through feedback (hereinafter, the feedback will be denoted as "F/B") in such a manner that an actual rail pressure, which is measured through a rail pressure sensor, coincides with a target rail pressure, which is computed based on an operational state of the internal combustion engine (hereinafter, simply referred to as an engine). For example, Japanese Unexamined Patent Publication No. 2000-282929 discloses this technique.

Here, the common rail type fuel injection apparatus is operated in such a manner that the fuel is always filled in the system, which includes the supply pump arrangement.

However, when the remaining amount of fuel in the fuel tank becomes relatively small or when the air is not sufficiently removed from the system, the air may possibly enter through an inlet of the supply pump arrangement to cause inclusion of the air in the supply pump arrangement.

When the air enters the supply pump arrangement, the following phenomena occur.

That is, when the air enters the supply pump arrangement, the actual rail pressure of the common rail drops. The drop in the actual rail pressure of the common rail, in turn, causes an integral term of the F/B control to become an excessive integral. Then, this causes the degree of opening of the intake metering valve to become excessively large. Therefore, the opening degree of the intake metering valve becomes its full open degree. Thus, the supply pump arrangement is operated at its full open state with a full pumping command supplied thereto.

When the air, which is entered into the supply pump arrangement, is discharged from the supply pump arrangement to eliminate the inclusion of the air in the supply pump arrangement, the supply pump arrangement outputs the fuel at its maximum capacity due to the presence of the full pumping command. Thus, the actual rail pressure of the common rail is increased to cause overshooting of the actual rail pressure due to the fact that the integral term of the F/B control is a value, which is obtained by adding a current integral term to a previous integral term and thereby does not change rapidly (see the line $\alpha$ in FIG. 1).

As discussed above, when the inclusion of the air in the supply pump arrangement is eliminated, the actual rail pressure could become an abnormally high pressure due to the excessive overshooting.

Furthermore, when the actual rail pressure becomes the abnormally high pressure due to the above reason, a safety device for avoiding the abnormality programmed in an engine control unit (ECU) is operated, so that stalling of the engine or driving of the vehicle in a limp-home mode may disadvantageously occur.

SUMMARY OF THE INVENTION

The present invention addresses the above disadvantages. Thus, it is a first objective of the present invention to provide a fuel injection apparatus, which is capable of limiting an excessive increase in a degree of opening of an intake metering valve caused by feedback control at time of substantial reduction of an actual rail pressure of a common rail with respect to a target rail pressure induced by, for example, inclusion of air in a supply pump arrangement, and which is also capable of limiting an abnormal increase in the actual rail pressure caused by excessively large opening of the intake metering valve at time of increasing the actual rail pressure induced by, for example, elimination of the inclusion of air in the supply pump arrangement. It is a second objective of the present invention to provide a subject device control system, which is capable of limiting excessive operation of a subject device at time of occurrence of large disorder of an output result of the subject device with respect to a target output, and which is also capable of limiting occurrence of a trouble caused by excessive operation of the subject device at time of elimination of the disorder.

To achieve the objectives of the present invention, there is provided a fuel injection apparatus, which includes a common rail, an injector, a supply pump arrangement, an intake metering valve, a rail pressure sensor, a feedback control means, a disorder degree sensing means and a limiting means. The common rail accumulates high pressure fuel. The injector injects the high pressure fuel, which is accumulated in the common rail. The supply pump arrangement includes a high pressure pump, which has a pressurizing chamber. The high pressure pump draws and pressurizes fuel in the pressurizing chamber and discharges the pressurized fuel from the pressurizing chamber to the common rail. The intake metering valve is arranged in a fuel passage, which is communicated with the pressurizing chamber to supply the fuel to the pressurizing chamber. A degree of opening of the intake metering valve is variable to control an actual pressure, which is accumulated in the common rail. The rail pressure sensor senses the actual rail pressure, which is accumulated in the common rail. The feedback control means is for feedback-controlling the degree of opening of the intake metering valve in a manner that approximates the actual rail pressure, which is measured with the rail pressure sensor, to a target rail pressure. The disorder degree sensing means is for sensing a disorder degree of the actual rail pressure, which is sensed with the rail pressure sensor. The limiting means is for limiting an increase in the degree of opening of the intake metering valve when the disorder degree of the actual rail pressure, which is sensed by the disorder degree sensing means, is relatively large and thereby exceeds a predetermined value.

Here, the disorder of the actual rail pressure is a degree of variation of the actual rail pressure of the common rail with respect to the target rail pressure, which is obtained by feed forward, or an aimed rail pressure, which would be a stable rail pressure that is stabilized at normal time. The degree of the disorder (the disorder degree) of the actual rail pressure is defined by a mathematical factor (e.g., a degree of deviation of the actual rail pressure with respect to the aimed rail pressure, a duration time period of a deviated state of the actual rail pressure with respect to the aimed rail pressure, a change rate of the actual rail pressure with respect to the aimed rail pressure, a degree of an integral value, or a change rate of the integral value), which is induced when the disorder of the actual rail pressure becomes relatively large.

To achieve the objectives of the present invention, there is also provided a subject device control system, which includes a subject device, a sensor, a feedback control means, a disorder degree sensing means, and a limiting means. The subject device is controlled for an output result thereof. The sensor senses the output result of the subject device. The feedback control means is for feedback-controlling an operational state of the subject device in such a manner that the output result of the subject device, which is senses by the sensor, approximates to a target output. The disorder degree sensing means is for sensing a disorder degree of the output result, which is sensed with the sensor. The limiting means is for limiting an operational change of the subject device when the disorder degree of the output result, which is sensed by the disorder degree sensing means, is relatively large and thereby exceeds a predetermined value.

BRIEF DESCRIPTION OF THE DRAWINGS

The invention, together with additional objectives, features and advantages thereof, will be best understood from the following description, the appended claims and the accompanying drawings in which:

Figure 1:
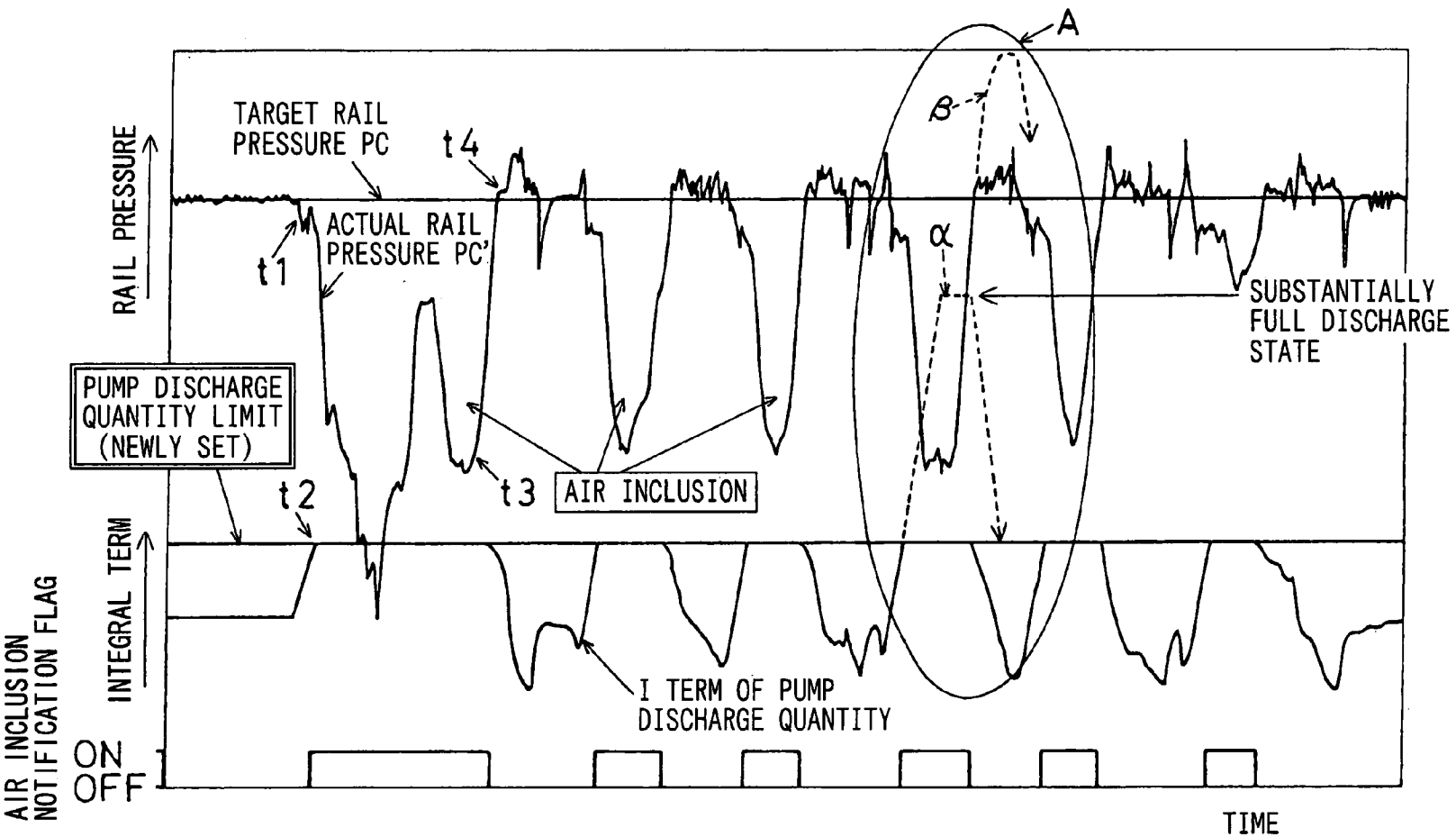
FIG. 1 is a time chart showing a change in an actual rail pressure and a change in an integral term at the time of repeating air inclusion and elimination of the air inclusion.

DETAILED DESCRIPTION OF THE INVENTION (First Embodiment)

A first embodiment of the present invention will be described with reference to FIGS. 1 to 4.

First, a structure of a common rail type fuel injection apparatus according to the present embodiment will be described with reference to FIGS. 3 and 4.

The common rail type fuel injection apparatus is an apparatus, which injects fuel into an internal combustion engine, such as a diesel engine (hereinafter, referred to as an engine) 1. The fuel injection apparatus includes a common rail 2, injectors 3, a supply pump arrangement 4 and an ECU 5.

The common rail 2 is an accumulator, which accumulates high pressure fuel to be supplied to the injectors 3. The common rail 2 is connected to an outlet of the supply pump arrangement 4, from which high pressure fuel is discharged, through a fuel line (a high pressure fuel flow line) 6 in such a manner that a rail pressure, which corresponds to a fuel injection pressure, is continuously accumulated in the common rail 2.

Leaked fuel, which is leaked from the injectors 3, is returned to a fuel tank 8 through a leak line (a fuel return flow line) 7.

A pressure limiter 11 is provided in a relief line (a fuel return flow line) 9, which extends from the common rail 2 to the fuel tank 8. The pressure limiter 11 is a pressure relief valve, which is opened when the fuel injection pressure in the common rail 2 exceeds a preset limit pressure, so that the fuel injection pressure of the common rail 2 is kept equal to or less than the preset limit pressure.

The injectors 3 are provided to cylinders, respectively, of the engine 1 to inject fuel into the respective cylinders. The injectors 3 are connected to downstream ends of branched lines, which are branched from the common rail 2. Each injector 3 includes a fuel injection nozzle and an electric actuator (e.g., a solenoid valve, a piezoelectric actuator). The fuel injection nozzle injects the high pressure fuel, which is accumulated in the common rail 2, into the corresponding cylinder. The electric actuator controls lifting of a needle, which is received in the fuel injection nozzle.

Next, the supply pump arrangement 4 will be described with reference to FIG. 4.

The supply pump arrangement 4 feeds the compressed high pressure fuel to the common rail 2 and includes a feed pump 12, a regulator valve 13, an intake metering valve (a controlled subject device) 14 and a plurality (two in the embodiment) of high pressure pumps 15. In FIG. 4, the feed pump 12 is rotated 90 degrees from its actual position to show the structure of the feed pump 12.

The feed pump 12 is a low pressure supply pump, which draws fuel from the fuel tank 8 and feeds the drawn fuel to the high pressure pumps 15. In this embodiment, the feed pump 12 is a trochoid pump that is rotated by a camshaft 16. When the feed pump 12 is driven, fuel, which is drawn through a fuel inlet 17, is supplied to the two high pressure pumps 15 through the intake metering valve 14.

Figure 3:
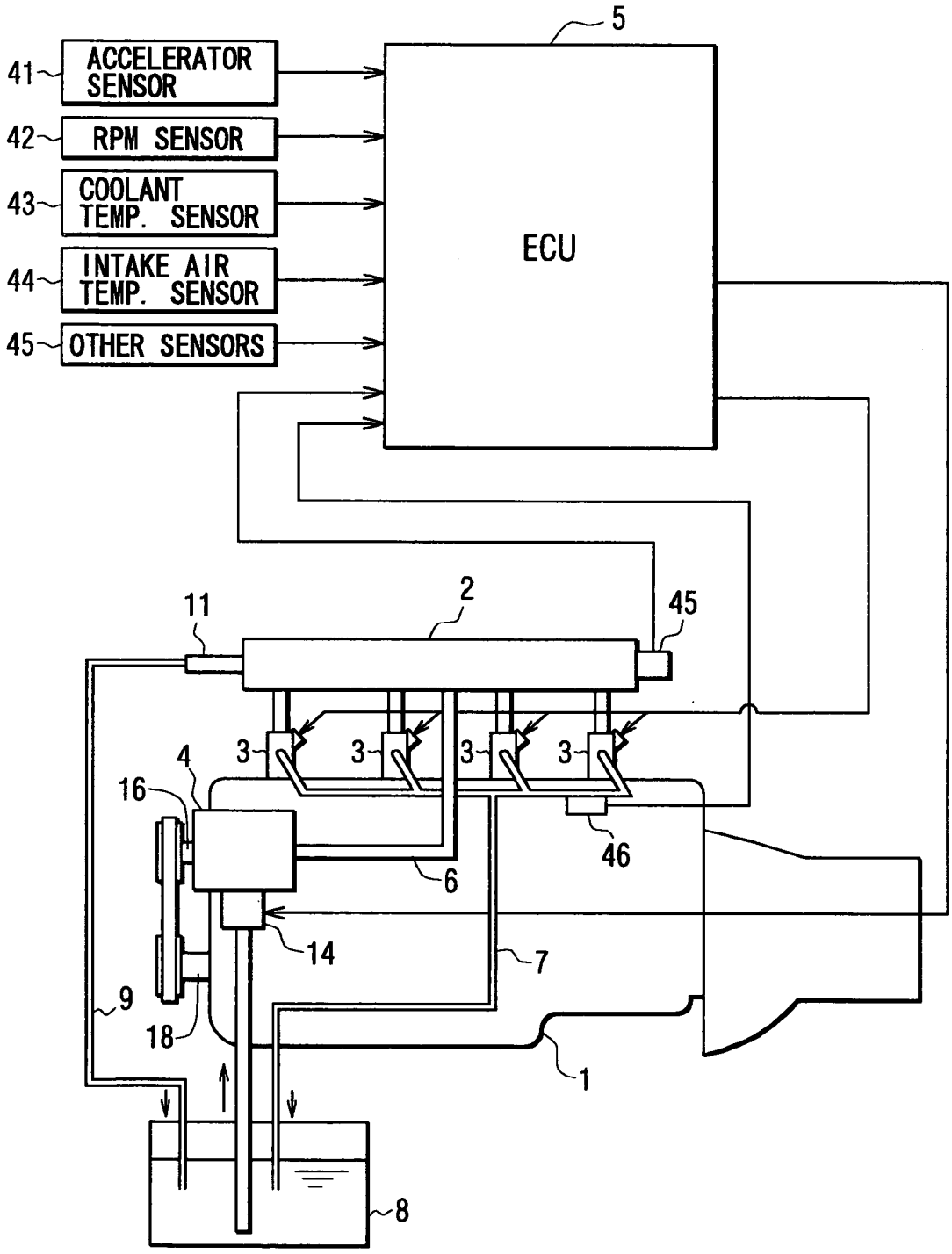
FIG. 3 is a schematic diagram of a common rail type fuel injection apparatus.
Figure 4:
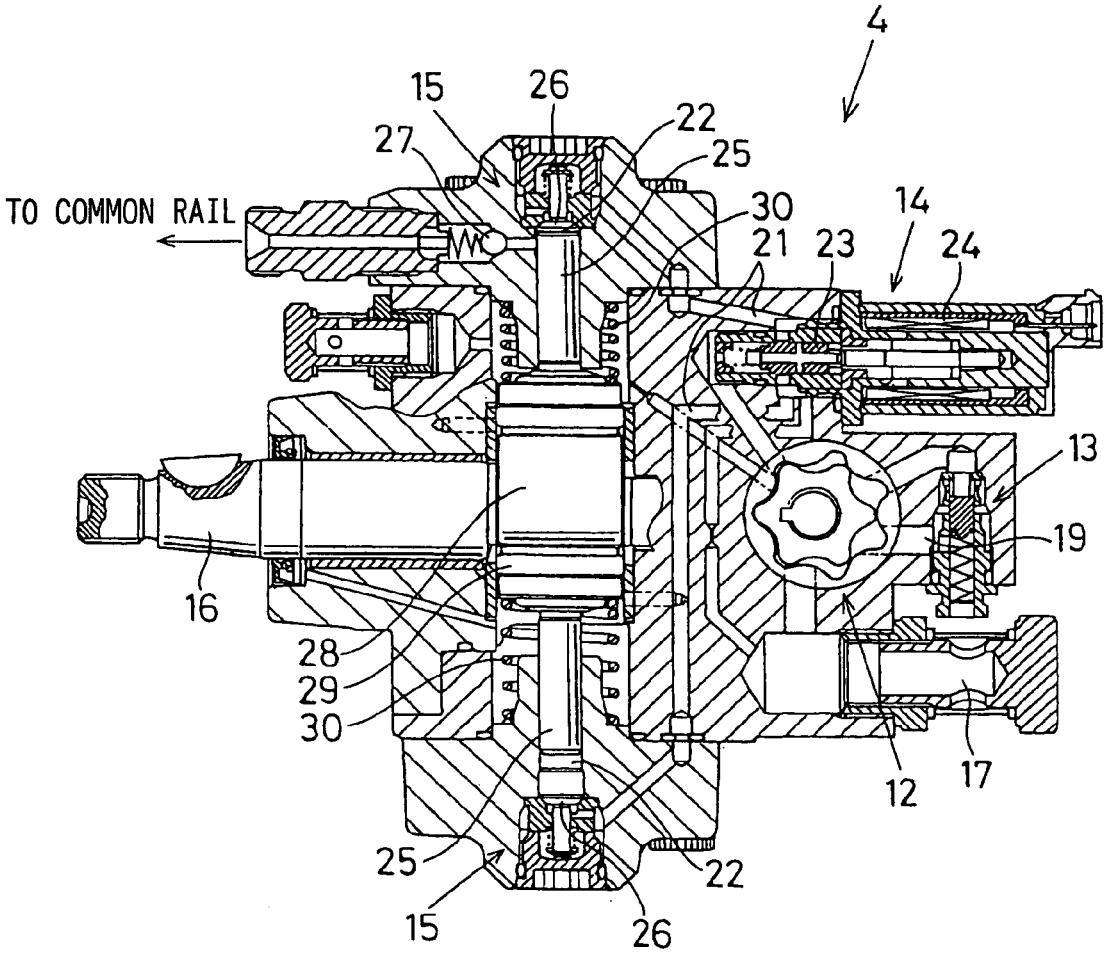
FIG. 4 is a cross sectional view of the supply pump arrangement.

The camshaft 16 is a pump drive shaft, which is driven through rotation of a crankshaft 18 of the engine 1, as shown in FIG. 3.

The regulator valve 13 is arranged in a fuel flow line 19, which communicates between an outlet side and an inlet side of the feed pump 12. When the discharge pressure of the feed pump 12 is increased to a predetermined pressure, the regulator valve 13 is opened, so that the discharge pressure of the feed pump 12 is kept equal to or less than the predetermined pressure.

The intake metering valve 14 is arranged in a fuel passage 21, which conducts fuel from the feed pump 12 to the high pressure pumps 15. The intake metering valve 14 adjusts the amount of fuel drawn into a pressurizing chamber 22 (a plunger chamber) of each high pressure pump 15 to control the rail pressure.

The intake metering valve 14 includes a valve 23 and an electric actuator (a linear solenoid 24 in this embodiment). The valve 23 changes a degree of opening of the fuel passage 21, which conducts fuel from the feed pump 12 to each high pressure pump 15. The electric actuator adjusts a degree of opening of the valve 23 by way of drive electric current, which is supplied from the ECU 5. In this embodiment, the intake metering valve 14 is of a normally closed type, in which the degree of opening of the valve 23 becomes zero, i.e., is fully closed when energization of the linear solenoid 24 is stopped.

The two high pressure pumps 15 are respectively formed as two plunger pumps that are driven to repeat intake and compression of fuel at different cycles, respectively, which are phase-shifted 180 degrees from each other. The high pressure pumps 15 compress the fuel, which is metered through the intake metering valve 14, and then supply the compressed high pressure fuel to the common rail 2. Each high pressure pump 15 includes a plunger 25, an intake valve 26 and a delivery valve 27. The plunger 25 is reciprocally driven by the common camshaft 16. The intake valve 26 supplies fuel to the pressurizing chamber 22. The volume of the pressurizing chamber 22 is changed thorough the reciprocal movement of the plunger 25. The delivery valve 27 discharges the compressed fuel, which is compressed in the pressurizing chamber 22, to the common rail 2.

Each spring 30 urges the corresponding plunger 25 against a cam ring 29, which is installed around an eccentric cam 28 of the camshaft 16. When the camshaft 16 is rotated, the plunger 25 is reciprocally driven thorough eccentric movement of the cam ring 29.

When the plunger 25 is moved downward, i.e., is moved radially inward, the pressure of the pressurizing chamber 22 is reduced. At the same time, the delivery valve 27 is closed, and the intake valve 26 is opened. Thus, the fuel, which is metered through the intake metering valve 14, is supplied to the pressurizing chamber 22.

In contrast, when the plunger 25 is moved upward, i.e., is moved radially outward, the pressure in the pressurizing chamber 22 is increased, and the intake valve 26 is closed. When the pressure of the pressurizing chamber 22 is increased to the predetermined pressure, the delivery valve 27 is opened. Thus, the high pressure fuel, which is pressurized in the pressurizing chamber 22, is discharged from the pressurizing chamber 22 through the delivery valve 27 toward the common rail 2.

The ECU 5 has a computer of a known type, which includes a CPU, a storage means (e.g., a memory, such as a ROM, a standby RAM, an EEPROM, a RAM), an input circuit, an output circuit and a power supply circuit. The CPU executes control processes and computation processes. The storage means stores various programs and data. The computation processes are executed based on sensor signals (engine parameters: signals, which correspond to an operational state of a driver and/or an operational state of the engine 1), which are supplied to the ECU 5.

The ECU 5 has functions of an electric drive unit (EDU), which provides drive electric current to electric functional components. These functions of the EDU include, for example, a function of an injector drive circuit, which supplies a drive signal to the injectors 3, and a function of a pump drive circuit, which supplies a drive signal to the intake metering valve 14 of the supply pump arrangement 4. In the present embodiment, although the EDU is provided in the ECU 5, the EDU may be provided separately from the ECU 5 in some cases.

With reference to FIG. 3, the sensors, which are connected to the ECU 5, include an accelerator sensor 41, a rotational speed (rpm) sensor 42, a coolant temperature sensor 43, an intake air temperature sensor 44, a rail pressure sensor 45, a fuel temperature sensor 46 and other sensor(s) 47. The accelerator sensor 41 senses a degree of opening of an accelerator (an amount of depression of an accelerator pedal). The rotational speed sensor 42 senses an engine rotational speed (rpm). The coolant temperature sensor 43 senses a temperature of coolant of the engine 1. The intake air temperature sensor 44 senses a temperature of intake air, which is drawn into the engine 1. The rail pressure sensor 45 senses an actual rail pressure PC', which is an actual pressure of fuel accumulated in the common rail 2. The fuel temperature sensor 46 senses the temperature of fuel, which is supplied to the injectors 3.

The ECU 5 includes an injection pattern determining means, a target injection quantity computing means and a target injection timing computing means, as control programs for controlling the injectors 3. The injection pattern determining means determines an injection pattern for each injection based on a corresponding program stored in the ROM and the sensor signals (engine parameters) obtained and stored in the RAM. The target injection quantity computing means computes a target injection quantity for each injection. The target injection timing computing means computes target injection timing for each injection.

The injection pattern determining means is the control program for determining the injection pattern (e.g., a single injection, multi-stage injection) of each injector 3, which corresponds to the current operational state.

The target injection quantity computing means is the control program for obtaining the target injection quantity, which corresponds to the current operational state, and for obtaining a requested injector drive time period for achieving the target injection quantity.

The target injection timing computing means is the control program for obtaining the target injection timing, which corresponds to the current operational state, and for obtaining requested injection timing for initiating the injection at the target injecting timing.

The ECU 5 further includes a target rail pressure computing means and an F/B control means, as control programs for controlling the actual rail pressure PC', which is accumulated in the common rail 2. The target rail pressure computing means computes a target rail pressure PC. The F/B control means approximates or adjusts the actual rail pressure PC' to the target rail pressure PC.

The target rail pressure computing means is the control program for obtaining the target rail pressure PC (or, alternatively, a requested discharge quantity or a requested electric current value) through a feed forward control operation based on a corresponding program stored in the ROM and sensor signals (engine parameters) obtained and stored in the RAM.

The F/B control means is the control program for comparing the target rail pressure PC obtained by the target rail pressure computing means with the actual rail pressure PC' measured through the rail pressure sensor 45 and for approximating the actual rail pressure PC' to the target rail pressure PC based on a pressure difference between the target rail pressure PC and the actual rail pressure PC' (deviation: $\Delta PC = PC - PC'$). Specifically, the F/B control means obtains a proportional term (P term) and an integral term (I term) based on the pressure difference between the target rail pressure PC and the actual rail pressure PC'. Then, the F/B control means corrects a basic control value (e.g., the target rail pressure PC, the requested discharge quantity, the requested electric current value) based on a PI value (a feedback value), which is obtained by summing the proportional term and the integral term. In this way, the actual rail pressure PC' is approximated to the target rail pressure PC.

Alternatively, a differential term (D term) may be obtained besides the proportional term (P term) and the integral term (I term), and the basic control value (e.g., the target rail pressure PC, the requested discharge quantity, the requested electric current value) may be corrected based on a PID value (a feedback value), which is obtained by summing the proportional term (P term), the integral term (I term) and the differential term (D term).

A specific example of the rail pressure control system will be described. In this specific example, a requested basic discharge quantity (a basic control value) is obtained based on the sensor signals (engine parameters), which are obtained and stored in the RAM. Then, the requested basic discharge quantity is corrected by the F/B control means.

Besides the target rail pressure computing means and the F/B control means, the ECU 5 further includes a basic value computing means, a pump efficiency correcting means, an individual device-specific deviation learning and correcting means, a discharge quantity/electric current amount converting means and an electric current amount/duty ratio converting means.

The basic value computing means computes a requested basic discharge quantity per pumping cycle of the supply pump arrangement 4. More specifically, the basic value computing means sums the injection quantity of the injectors 3 and the leak quantity (the static leak quantity+the dynamic leak quantity), and then the basic value computing means multiplies this sum value of the injection quantity of the injectors 3 and the leak quantity by the number (in a case of two injections per pumping cycle, the number is two) of injections per pumping cycle of the high pressure pump 15 (the plunger 25) to obtain the required basic discharge quantity.

Based on the pressure difference between the target rail pressure PC, which is obtained by the target rail pressure computing means, and the actual rail pressure PC', which is measured with the rail pressure sensor 45, the F/B control means of this specific example computes the F/B quantity (the proportional term and the integral term for correcting the discharge quantity) for approximating the actual rail pressure PC' to the target rail pressure PC. Then, the F/B control means adds the F/B quantity (the proportional term+the integral term) to the requested basic discharge quantity, which is obtained by the basic value computing means to correct the requested basic discharge quantity.

The pump efficiency correcting means computes an intake efficiency, which corresponds to the engine rotational speed (rpm), and then the pump efficiency correcting means corrects the requested basic discharge quantity+F/B quantity based on the intake efficiency, more specifically, by multiplying the intake efficiency.

The individual device-specific deviation learning and correcting means adds an individual pump-specific discharge quantity deviation, which is stored at the time of factory shipment or at the time of learning operation, to the above value, which is obtained by (the requested basic discharge quantity+F/B quantity)×the intake efficiency.

The discharge quantity/electric current amount converting means converts the above value, which is obtained by [(the requested basic discharge quantity+the F/B quantity)×the intake efficiency]+the individual pump-specific discharge quantity deviation, to a target electric current value.

The electric current amount/duty ratio converting means converts the target electric current value to a drive duty ratio.

When the drive duty ratio is supplied to the pump drive circuit of the EDU, the pump drive circuit outputs a drive electric current, which corresponds to the supplied duty ratio, to the intake metering valve 14. As a result, the opening degree of the fuel passage 21, which communicates with the pressurizing chamber 22, is controlled to control the discharge quantity of the supply pump arrangement 4, so that the actual rail pressure PC' of the common rail 2 is controlled.

Normally, the common rail type fuel injection apparatus is operated in the filled state where fuel is always filled in the system, which includes the supply pump arrangement 4.

However, when the remaining amount of fuel in the fuel tank 8 is relatively small or when the air is not sufficiently removed from the system, the air may enter through the inlet of the supply pump arrangement 4.

When the air enters the supply pump arrangement 4, the following phenomena occur as discussed in the beginning of the specification.

As indicated by a solid line in a portion of the graph indicated by an elliptic line A in FIG. 1, when the air enters the supply pump arrangement 4, the actual rail pressure PC' largely drops relative to the target rail pressure PC. Then, as indicated by the dotted line α in the elliptic line A in FIG. 1, the integral term (I term) of the F/B control becomes an excessive integral, and thereby the degree of opening of the intake metering valve 14 becomes excessively large. Therefore, the opening degree of the intake metering valve 14 becomes fully opened (a full open value). Thus, the supply pump arrangement 4 is operated with the full pumping command.

Thereafter, when the air entered into the supply pump arrangement 4 is discharged from the supply pump arrangement 4 to eliminate the inclusion of the air in the supply pump arrangement 4, the supply pump arrangement 4 outputs fuel at its maximum capacity due to the presence of the full pumping command. Then, as indicated by a dotted line β in the elliptic line A of FIG. 1, the excessive overshooting of the actual rail pressure PC' occurs due to the fact that the integral term of the F/B control is the value, which is obtained by adding the current integral term to the previous integral term and thereby does not change rapidly.

The first characteristic of the first embodiment will be described.

The ECU 5 of the first embodiment includes functions of a disorder degree sensing means and of a limiting means. The disorder degree sensing means senses a disorder degree (degree of disorder) of the actual rail pressure PC', which is measured with the rail pressure sensor 45. The limiting means limits an increase in the degree of opening of the intake metering valve 14 when the disorder degree, which is sensed by the disorder degree sensing means, is relatively large.

The disorder degree sensing means determines that the disorder degree of the actual rail pressure PC' is relatively large when the integral term, which is obtained based on the pressure difference between the target rail pressure PC and the actual rail pressure PC', becomes relatively large.

The limiting means is a control program for limiting an increase in the degree of opening of the intake metering valve 14 by setting an upper limit of the integral term, which is computed by the F/B control means. The upper limit value of the integral term may be a predetermined fixed value or a variable value, which varies according to an engine parameter, such as the engine rotational speed (rpm).

Specifically, the disorder degree sensing means and the limiting means constitute a limiting program, which sets the predetermined upper limit value of the integral term of the F/B control in the normal operational state, in which the common rail type fuel injection apparatus (specifically, the components of the common rail type fuel injection apparatus, such as the rail pressure sensor 45) has no trouble (no failure) and is operated normally, so that an increase of the integral term beyond the upper limit value is limited.

In the present embodiment, as shown in the bottom part of FIG. 1, an air inclusion notification flag is set in the state, in which the control means limits the integral term, and the actual rail pressure PC' is reduced from the target rail pressure PC.

The second characteristic of the first embodiment will be described.

The ECU 5 of the first embodiment further includes functions of a target correcting means and of a warning generating means. The target correcting means corrects the current target rail pressure PC to a lower value, which is lower than the current target rail pressure PC, when the limiting means limits an increase in the degree of opening of the intake metering valve 14. The warning generating means provides a warning to the occupant of the vehicle when the limiting means limits an increase in the degree of opening of the intake metering valve 14.

The target correcting means is a control program, which implements a fail-safe mode by correcting the target rail pressure PC to the lower value when the state (trigger state), in which the limitation of the integral term by the limiting means and the reduction of the actual rail pressure PC' from the target rail pressure PC exist, is kept equal to or longer than a predetermined time period (i.e., when the air inclusion notification flag is set). A correction amount for correcting the target rail pressure PC to the lower value may be a predetermined fixed value or a variable value, which varies according to an engine parameter, such as the engine rotational speed (rpm).

The warning generating means is a control program, which operates a visual display means, such as a lamp, to notify the current execution of the fail-safe mode to the vehicle occupant when the state, in which the limitation of the integral term by the limiting means and the reduction of the actual rail pressure PC' from the target rail pressure PC exist, is kept equal to or longer than the predetermined time period (i.e., when the air inclusion notification flag is set). The predetermined time period may be a predetermined fixed value or a variable value, which varies according to an engine parameter, such as the engine rotational speed (rpm).

An exemplary control operation, which is performed in the case of the inclusion of the air in the supply pump arrangement 4, will be described with reference to a flowchart of FIG. 2.

Figure 2:
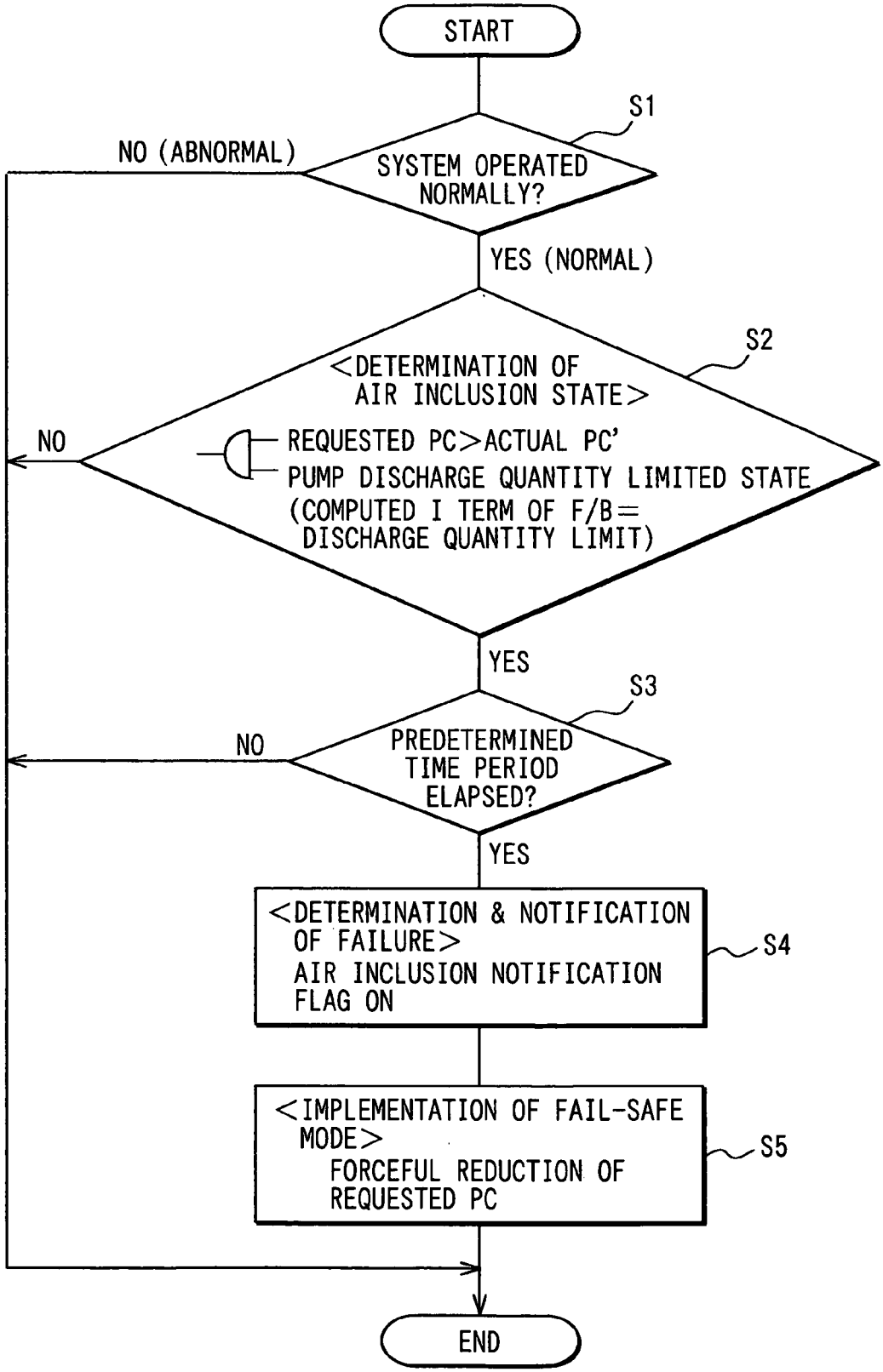
FIG. 2 is a flowchart showing an exemplary control in a case of inclusion of air in a supply pump arrangement.

When a control routine shown in FIG. 2 is started, it is determined whether the common rail type fuel injection apparatus or system (specifically, the components of the common rail type fuel injection apparatus, such as the rail pressure sensor 45) has no trouble and is operated normally (step S1).

When the result of the determination at step S1 is NO (abnormal), the control routine ends.

In contrast, when the result of the determination at step S1 is YES (normal), it is determined whether there is the state, in which the limitation of the integral term by the limiting means and the reduction of the actual rail pressure PC' from the target rail pressure (requested rail pressure) PC exist (step S2).

When the result of the determination at step S2 is NO, it is determined that the operation of the supply pump arrangement 4 is normal, and the current control routine ends.

In contrast, when the result of the determination at step S2 is YES, it is determined whether current state, in which the limitation of the integral term by the limiting means and the reduction of the actual rail pressure PC' from the target rail pressure PC exist, has been kept equal to or longer than the predetermined time period (step S3).

When the result of the determination at step S3 is NO, it is determined that the fail-safe mode needs not be implemented at this time point, and thereby the current control routine ends.

In contrast, when the result of the determination at step S3 is YES, it is understood that the current state, in which the limitation of the integral term by the limiting means and the reduction of the actual rail pressure PC' from the target rail pressure PC exist, has been kept equal to or longer than the predetermined time period. Thus, the visual display means (e.g., the lamp) is operated to notify the execution of the fail-safe mode to the vehicle occupant (step S4), and the target rail pressure PC is forcefully reduced to the lower value to implement the fail-safe mode (step S5). Thereafter, the current control routine ends.

Effects and advantages of the first embodiment will be described with reference to the time chart shown in FIG. 1.

In the operational state, in which fuel is filled in the system that includes the supply pump arrangement 4, when the air enters the supply pump arrangement 4 (time t1), the actual rail pressure PC' is significantly reduced relative to the target rail pressure PC. Thus, the integral term (I term) of the F/B control begins to increase. However, the integral term is limited to the predetermined value by the limiting means (time t2).

When the inclusion of the air in the supply pump arrangement 4 is eliminated (time t3), the supply pump arrangement 4 pumps fuel, and thereby the actual rail pressure PC' increases. In the case of the previously proposed art, when the actual rail pressure PC' increases to the target rail pressure PC (time t4), the integral term is increased excessively, so that the supply pump arrangement pumps excessively, and thereby overshooting occurs. In contrast to the previously proposed art, according to the first embodiment, the integral term is limited to the predetermined value by the limiting means while the actual rail pressure PC' is reduced from the target rail pressure PC. Thus, according to the first embodiment, when the actual rail pressure PC' increases to the target rail pressure PC (time t4), the degree of opening of the intake metering valve 14 is limited, and thereby the excessive overshooting right after the time t4 is limited.

That is, it is possible to limit the abnormal increase of the actual rail pressure PC' at the time of increasing of the actual rail pressure PC' after the elimination of the inclusion of the air in the supply pump arrangement 4 upon entering of the air into the supply pump arrangement 4.

Furthermore, according to the first embodiment, when the actual rail pressure PC' is significantly reduced due to, for example, the inclusion of the air in the supply pump arrangement 4, the reduction of the output caused by the inclusion of the air in the supply pump arrangement 4 is notified to the vehicle occupant. Thus, the information, which indicates the reduction of the output of the supply pump arrangement 4 due to the inclusion of the air in the supply pump arrangement 4, can be effectively notified to the vehicle occupant.

Furthermore, according to the first embodiment, when the actual rail pressure PC' is reduced due to the inclusion of the air in the supply pump arrangement 4, the fail-safe mode is implemented to temporarily reduce the target rail pressure PC for the safety purpose. Thus, even when the air enters into the supply pump arrangement 4 during the running of the vehicle, it is possible to provide a high degree of safety.

(Second Embodiment)

A second embodiment of the present invention will be described with reference to a section (a) of FIG. 5.

The first characteristic of the second embodiment will be described.

In the first embodiment, the disorder degree sensing means is implemented by sensing the disorder degree of the actual rail pressure PC' based on the integral term of the pressure difference ΔPC between the target rail pressure PC and the actual rail pressure PC'.

In contrast, the disorder degree sensing means of the second embodiment senses the disorder of the actual rail pressure PC' based on the direct pressure difference ΔPC between the target rail pressure PC and the actual rail pressure PC'.

Figure 5:
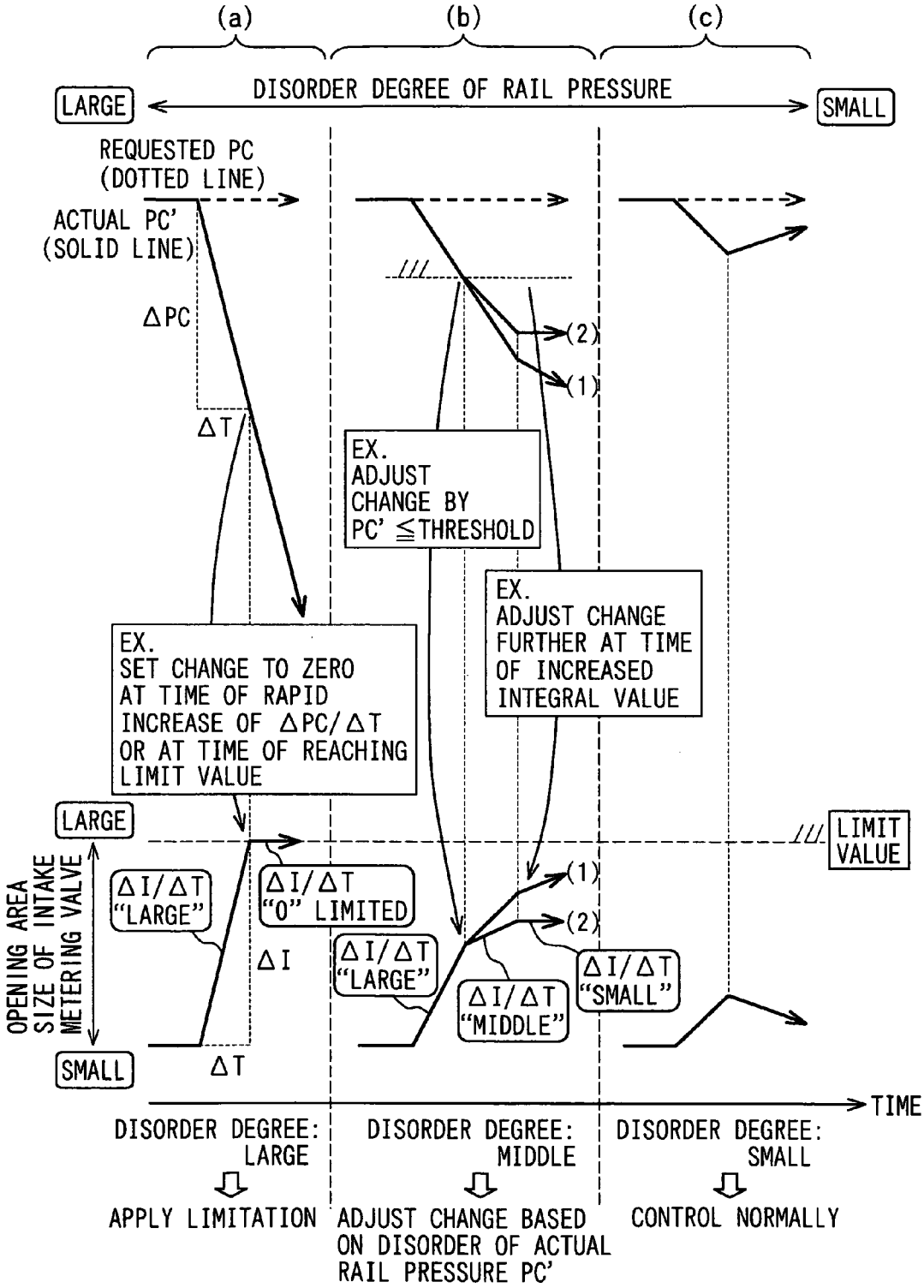
FIG. 5 is a time chart showing a change in an actual rail pressure and a change in an opening area size of an intake metering valve.

Specifically, the disorder degree sensing means of the second embodiment senses the disorder of the actual rail pressure PC' based on a change rate (ΔPC/ΔT) of the direct pressure difference ΔPC between the target rail pressure PC and the actual rail pressure PC', as shown in a top part of the section (a) of FIG. 5. The change rate, which is used as a reference for determining the presence of the relatively large disorder degree, may be a predetermined fixed value or a variable value, which varies according to an engine parameter, such as the engine rotational speed (rpm).

The second characteristic of the second embodiment will be described.

In the first embodiment, the case of limiting the integral term by the F/B control means is described as the limiting means.

In contrast, the limiting means of the second embodiment is one that sets an upper limit of the degree of opening of the intake metering valve 14.

Specifically, as indicated in a bottom part of the section (a) of FIG. 5, the limiting means of the second embodiment sets the upper limit of the degree of opening of the intake metering valve 14 and thereby limits an opening area size of the intake metering valve 14 within a predetermined range. The upper limit value of the degree of opening of the intake metering valve 14 may be a predetermined fixed value or a variable value, which varies according to an engine parameter, such as the engine rotational speed (rpm).

The second embodiment may be combined with the first embodiment to increase the control range.

(Third Embodiment)

A third embodiment of the present invention will be described with reference to a section (b) of FIG. 5.

In the first and second embodiments, the control of the intake metering valve 14 is limited only in the case where the disorder degree of the actual rail pressure PC' is relatively large.

In contrast, according to the third embodiment, even in a case where the disorder degree of the actual rail pressure PC' is moderate (middle), the corresponding limitation, which corresponds to the disorder degree of actual rail pressure PC', is applied to the intake metering valve 14.

According to the third embodiment, as indicated by (1) and (2) in a top part of a section (b) of FIG. 5, when the direct pressure difference ΔPC between the target rail pressure PC and the actual rail pressure PC' exceeds a threshold value, the disorder degree sensing means determines that the disorder degree is relatively large. In such a case where the disorder degree is determined to be relatively large, as indicated by (1) and (2) in a bottom part of the section (b) of FIG. 5, the limiting means reduces a change rate of the degree of opening of the intake metering valve 14. In the present embodiment, the limiting means reduces the change rate of the degree of opening of the intake metering valve 14 in a linear manner or in a stepwise manner when the direct pressure difference ΔPC between the target rail pressure PC and the actual rail pressure PC' increases.

Here, the third embodiment may be combined with the first embodiment in such a manner that an upper limit vale of the integral term, which is used by the F/B control means, is provided to limit the change rate of the degree of opening of the intake metering valve 14 when the pressure difference ΔPC between the target rail pressure PC and the actual rail pressure PC' become relatively large. Furthermore, the third embodiment may be combined with the second embodiment, or the third embodiment may be combined with the first and second embodiments.

A section (c) of FIG. 5 shows a case where the disorder degree of the actual rail pressure PC' is relatively small, and therefore the limiting means is not operated.

Modifications of the above embodiments will be described.

In the above embodiments, the present invention is implemented in the control of the intake metering valve 14 of the common rail type fuel injection apparatus. Alternatively, the present invention may be implemented in any subject device control system that uses the F/B control, which approximates the output result of the controlled subject device (e.g., an electric actuator) to its target output using the PI control or the PID control.

In the above embodiments, the linear solenoid 24 is used as the exemplary electric actuator. However, there may be used any other actuator that can electrically vary its output, such as an actuator that uses a piezoelectric element or an actuator that uses an electric motor.

Additional advantages and modifications will readily occur to those skilled in the art. The invention in its broader terms is therefore not limited to the specific details, representative apparatus, and illustrative examples shown and described. For example, any one or more components of any one of the above embodiments can be combined with any one or more components of any other one of the above embodiments without departing from the sprit and scope of the invention.

What is claimed is:

1. A fuel injection apparatus comprising:

a common rail that accumulates high pressure fuel;

an injector that injects the high pressure fuel, which is accumulated in the common rail;

a supply pump arrangement that includes a high pressure pump, which has a pressurizing chamber, wherein the high pressure pump draws and pressurizes fuel in the pressurizing chamber and discharges the pressurized fuel from the pressurizing chamber to the common rail;

an intake metering valve that is arranged in a fuel passage, which is communicated with the pressurizing chamber to supply the fuel to the pressurizing chamber, wherein a degree of opening of the intake metering valve is variable to control an actual pressure, which is accumulated in the common rail;

a rail pressure sensor that senses the actual rail pressure, which is accumulated in the common rail;

a feedback control means for feedback-controlling the degree of opening of the intake metering valve in a manner that approximates the actual rail pressure, which is measured with the rail pressure sensor, to a target rail pressure;

a disorder degree sensing means for sensing a disorder degree of the actual rail pressure, which is sensed with the rail pressure sensor; and a limiting means for limiting an increase in the degree of opening of the intake metering valve when the disorder degree of the actual rail pressure, which is sensed by the disorder degree sensing means, is relatively large and thereby exceeds a predetermined value.

2. The fuel injection apparatus according to claim 1, wherein the disorder degree sensing means senses the disorder degree of the actual rail pressure based on an integral term of a pressure difference between the target rail pressure and the actual rail pressure.

3. The fuel injection apparatus according to claim 1, wherein the disorder degree sensing means senses the disorder degree of the actual rail pressure based directly on a pressure difference between the target rail pressure and the actual rail pressure.

4. The fuel injection apparatus according to claim 1, wherein the limiting means sets an upper limit for an integral term, which is computed by the feedback control mean, to limit the increase in the degree of opening of the intake metering valve.

5. The fuel injection apparatus according to claim 1, wherein the limiting means sets an upper limit for the opening degree of the intake metering valve to limit the increase in the degree of opening of the intake metering valve.

6. The fuel injection apparatus according to claim 1, wherein the limiting means reduces a change rate of the degree of opening of the intake metering valve to limit the increase in the degree of opening of the intake metering valve.

7. The fuel injection apparatus according to claim 1, further comprising a target correcting means for correcting the target pressure to a lower value, which is lower than the target pressure, when the limiting means limits the increase in the degree of opening of the intake metering valve.

8. The fuel injection apparatus according to claim 1, further comprising a warning generating means for providing a warning to a vehicle occupant when the limiting means limits the increase in the degree of opening of the intake metering valve.

9. A subject device control system comprising:

a subject device that is controlled for an output result thereof;

a sensor that senses the output result of the subject device;

a feedback control means for feedback-controlling an operational state of the subject device in such a manner that the output result of the subject device, which is senses by the sensor, approximates to a target output;

a disorder degree sensing means for sensing a disorder degree of the output result, which is sensed with the sensor; and a limiting means for limiting an operational change of the subject device when the disorder degree of the output result, which is sensed by the disorder degree sensing means, is relatively large and thereby exceeds a predetermined value.

* * * * *